US007236715B2

(12) United States Patent
Nishida et al.

(10) Patent No.: US 7,236,715 B2
(45) Date of Patent: Jun. 26, 2007

(54) IMAGE FORMING APPARATUS

(75) Inventors: Satoshi Nishida, Saitama (JP); Mikihiko Takada, Hino (JP); Shigetaka Kurosu, Hino (JP); Hiroshi Morimoto, Akiruno (JP); Kazuteru Ishizuka, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 11/127,404

(22) Filed: May 12, 2005

(65) Prior Publication Data

US 2006/0045558 A1 Mar. 2, 2006

(30) Foreign Application Priority Data

Aug. 31, 2004 (JP) ..... 2004-251685

(51) Int. Cl.
*G03G 15/02* (2006.01)

(52) U.S. Cl. ..... 399/93

(58) Field of Classification Search ..... None
See application file for complete search history.

(56) References Cited

U.S. PATENT DOCUMENTS 6,070,026 A * 5/2000 Claflin et al. ..... 399/92
6,944,413 B2 * 9/2005 Maeda ..... 399/92

FOREIGN PATENT DOCUMENTS

| | | | |
|---|---|---|---|
| JP | 04104267 A | * | 4/1992 |
| JP | 05313470 A | * | 11/1993 |
| JP | 08166697 A | * | 6/1996 |
| JP | 08286471 A | * | 11/1996 |
| JP | 10198128 A | * | 7/1998 |
| JP | 2000162934 A | * | 6/2000 |
| JP | 2001166569 A | * | 6/2001 |

* cited by examiner

*Primary Examiner*—Quana Grainger
(74) *Attorney, Agent, or Firm*—Cantor Colburn LLP

(57) ABSTRACT

An image forming apparatus, comprises an image carrier for carrying a toner image, a charging device for charging the carrier, wherein the charging device includes a discharge member and a grid which is arranged between this discharge member and the image carrier and has at least a surface made of gold; and a discharge product removing device for removing discharge products generated by the charging device from a portion of the image carrier to where the charging device is located to face.

15 Claims, 7 Drawing Sheets

IMAGE FORMING APPARATUS

BACKGROUND OF THE INVENTION

The present invention relates to an image forming apparatus based on electrophotographic technology comprising a charging device.

In an image forming apparatus for forming an image based on electrophotographic technology, a photoconductor as an image carrier is provided with uniform charging by a corona discharge type charging device as a charging means, and the image is exposed by an image exposure means to form a latent image. Then a toner image is created by a development means, and a toner image is transferred onto a recording medium by a transfer device.

The corona charge type charging device used in the image forming apparatus of this type can be broadly classified into two types; a wire discharge type and a pin discharge type (pin electrode type and serrated electrode type). A grid for controlling the potential of the photoconductor is arranged between a discharge member such as a wire and pin, and a photoconductor.

When the photoconductor is exposed to a discharged product such as ozone generated by corona discharge, the photoconductor is subjected to deterioration. Even when subjected to exposure, the potential of the photoconductor remains close to the level of discharge potential without dropping to a predetermined level. Thus, an image is not formed, and a white streak in the horizontal direction (axial direction of the photoconductor) appears in the image.

Such a phenomenon tends to occur particularly when image formation operation is restarted some time after completion of the previous image formation operation. This is because ozone and other discharge products remain in the charging device and these remnants spread over the surface of the photoconductor, with the result that the photoconductor is deteriorated.

To prevent such deterioration of the photoconductor, the following methods are known in the prior art, for example; a technique of removing ozone and others by blowing air flow into the charging device (Patent Document 1), and a technique of rotating the photoconductor a predetermined time after completion of printing, so that ozone and others are removed by the flow of air during the rotation of the photoconductor (Patent Document 2).

[Patent Document 1] Official Gazette of Japanese Patent Tokkaihei 5-313470

[Patent Document 2] Official Gazette of Japanese Patent Tokkaihei 4-104267

Either of the aforementioned prior art techniques has failed to solve the problem of photoconductor deterioration.

Through concentrated study efforts to analyze the cause of this problem, the present inventors have found out the following:

A wire grid using a stainless steel or tungsten, or a plate-formed grid with a pattern formed on a sheet metal of stainless steel and others by etching is utilized as a grid arranged between the photoconductor and discharge member to control the charging potential of the photoconductor. The grid in particular has a large surface area and is characterized by powerful adhesion of ozone and other discharge products on such a material as a stainless steel or tungsten. Ozone and other discharge products attached onto the grid surface cannot be removed sufficiently by flow of air by rotation. When the image formation operation is stopped thereafter, ozone and other discharge products will spread gradually over the surface of the photoconductor, with the result that the photoconductor deteriorates. In particular, the grid is arranged close to the photoconductor, and this influence is very serious.

Especially in recent years, there is an active demand for downsizing and high speed processing of the aforementioned image forming apparatus. To meet this requirement, it is necessary to reduce the diameter of the photoconductor drum, to minimize the dimensions of a corona charging device, image exposure means development means and others arranged in the peripheral area, and to lessen the space between processing means. Further, when a photoconductor drums are arranged for each color, the space between these photoconductor drums must be minimized. This arrangement reduces the space of the image forming apparatus as a whole, and ozone and other discharge products generated from the charging device remain around the photoconductor without being removed. A white streak appearing in the image resulting from deterioration of the photoconductor presents a big problem for downsizing and high speed processing of the apparatus.

SUMMARY OF THE INVENTION

In view of the prior art described above, it is an object of the present invention is to provide an image forming apparatus capable of minimizing deterioration of the photoconductor and forming an image free of a white streak.

Through concentrated study efforts to find a way for solving the aforementioned problem, the present inventors have found out the following: Use of a grid wherein at least the surface is made of gold reduces the force of adhesion between the grid surface and the aforementioned ozone and other discharge products.

The practice of using gold plating on the surface to improve the charging safety of the grid has been commonly known. However, little is known about relationship between the gold plating of the grid and deterioration of the photoconductor.

The object of the present invention can be achieved by the following Structure:

An image forming apparatus, comprising:

an image carrier for carrying a toner image;

a charging device for charging the carrier, wherein the charging device includes a discharge member and a grid which is arranged between this discharge member and the image carrier and has at least a surface made of gold; and a discharge product removing device for removing discharge products generated by the charging device from a portion of the image carrier to where the charging device is located to face.

DETAILED DESCRIPTION OF THE PREFERRED EMBODIMENT

Figure 1:
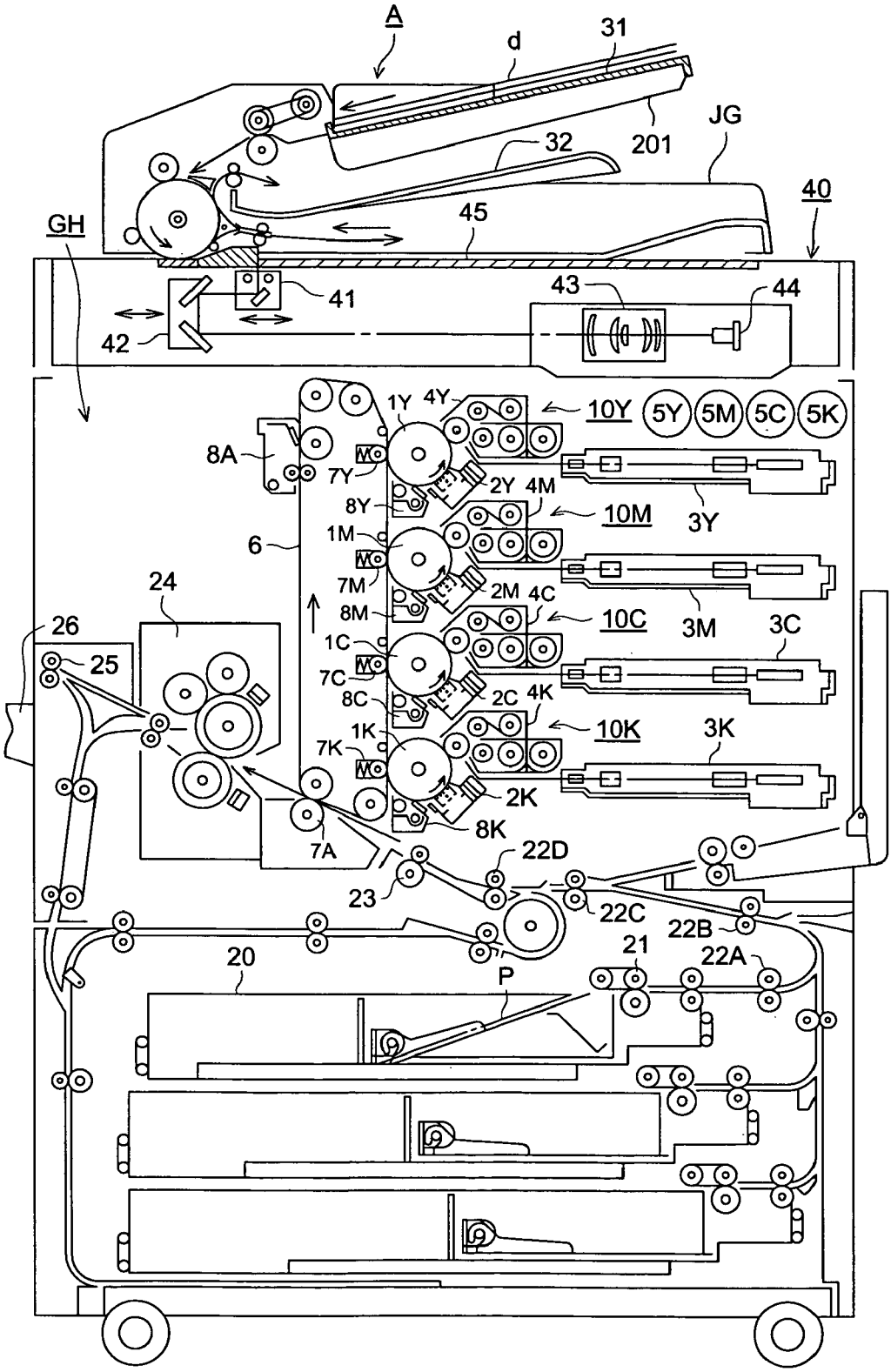
FIG. 1 is a drawing representing a structure of a color image forming apparatus as an example of the image forming apparatus as an embodiment of the present invention.

The following describes the embodiments of the present invention, without the present invention being restricted thereto:

The following describes the embodiments of the present invention. FIG. 1 is a drawing representing a structure of a color image forming apparatus as an example of the image forming apparatus as an embodiment of the present invention.

The color image forming apparatus comprises an image forming apparatus proper GH and automatic document conveyance apparatus JG.

The color image forming apparatus proper GH includes a plurality of image forming sections 10Y, 10M, 10C and 10K arranged in the vertical direction, a belt-shaped intermediate transfer member 6, a sheet feed and conveyance section and a fixing means 24.

A covering member can be provided for each of the four image forming sections 10Y, 10M, 10C and 10K so that four image forming units are configured.

The image forming section 10Y for forming a yellow image contains a charging means 2Y arranged around the photoconductor 1Y as an image carrier, an exposure means 3Y, a development means 4Y, a suction means 100Y (not illustrated) and a cleaning means 8Y. The image forming section 10M for forming a magenta colored image contains a photoconductor 1M as an image carrier, a charging means 2M, an exposure means 3M, a development means 4M, a suction means 100M (not illustrated) and a cleaning means 8M, similarly to the above. The image forming section 10C for forming a cyan colored image contains a photoconductor 1C as an image carrier, a charging means 2C, an exposure means 3C, a development means 4C, a suction means 100C (not illustrated) and a cleaning means 8C, similarly to the above. The image forming section 10K for forming a black colored image contains a photoconductor 1K as an image carrier, a charging means 2K, an exposure means 3K, a development means 4K, a suction means 100K (not illustrated) and a cleaning means 8K, similarly to the above. The charging means 2Y and exposure means 3Y, the charging means 2M and exposure means 3M, the charging means 2C and exposure means 3C, and the charging means 2K and exposure means 3K constitutes a latent image forming means. Numerals 5Y, 5M, 5C and 5K denote toner containers each accommodating yellow toner, magenta toner, cyan toner and black toner. These toner containers supply toner in the amounts to be consumed in the development means 4Y, 4M, 4C and 4K.

Photoconductors 1Y, 1M, 1C and 1K are negatively charged OPC photoconductors each composed of an OPC photosensitive layer formed on a metallic drum. Such a photoconductor as amorphous Si photoconductors other than OPC photoconductors can be used as the photoconductors 1Y, 1M, 1C and 1K. Further, these photoconductors can be positively charged. Further, the photoconductor can be formed in an endless belt instead of drum. The belt provided with the photoconductor layer should be applied to a plurality of rollers and should be rotated.

This image forming apparatus is further characterized in that the photoconductor is controlled at a predetermined time interval by a control means (not illustrated), when image formation is not performed. This rotation control can be provided at all times when image formation is not performed. Alternatively, rotation control can be provided as required, for example, only after completion of image formation. In this apparatus, the photoconductor is rotated at a predetermined time interval constantly when the power switch as a main power source is turned on and the image formation is disabled.

The charging means 2Y, 2M, 2C and 2K are the scorotron chargers provided with a grid the surface of which is made of gold. A discharge wire or serrated electrode can be used as the discharge member. In this apparatus, a discharge wire is used as the discharge member.

The charging means 2Y is arranged opposed to the photoconductor 1Y as a charged member. Discharge bias is applied to the discharge wire to cause corona discharge to be generated, so that electric charge is applied to the photoconductor 1Y. Thus, the photoconductor 1Y is charged. In this case, a grid is provided between the photoconductor 1Y and discharge wire. The amount of electric charge applied to the photoconductor is adjusted by the grid bias applied to the grid, whereby the charge potential is controlled. This grid can use the plate-formed grid with a pattern formed on the wire grid and sheet metal by etching. In the present apparatus, a plate-formed grid is used. Similarly, the charging means 2M charges the photoconductor 1M, the charging means 2C the photoconductor 1C, and the charging means 2K the photoconductor 1K, respectively.

The exposure means 3Y has a semiconductor laser as a light source, so that the photoconductor 1Y is subjected to dot exposure by a laser beam. Exposure is performed according to yellow image data. Similarly, the exposure means 3M causes the photoconductor 1M to be exposed, based on the magenta image data, the exposure means 3C causes the photoconductor 1C to be exposed, based on the cyan image data, and the exposure means 3K causes the photoconductor 1K to be exposed, based on the black image data. Such an exposure means as LED array and liquid crystal other than laser beam can be used as exposure means 3Y, 3M, 3C and 3K. It is preferred to use a means that provides dot exposure.

The development means 4Y, 4M, 4C and 4K can be either the development means that use a two-component developer containing toner and a carrier, or the development means that uses a one-component developer containing toner without a carrier. Further, the development means 4Y, 4M, 4C and 4K can be based on either the reversal development principle wherein toner is attached to the exposure section, or the normal development principle wherein toner is attached to unexposed sections. Either contact development or non-contact development method can be utilized. As described above, any known method can be used in the development means 4Y, 4M, 4C and 4K. However, it is preferred to use a reversal development means based on a two-component developer.

The intermediate transfer member 6 is an endless belt. Applied to a plurality of rollers, the intermediate transfer member 6 is supported so as to make a circular movement.

The images of various colors formed by the image forming sections 10Y, 10M, 10C and 10K are transferred sequentially onto on the intermediate transfer member 6 moving in circulation by transfer means 7Y, 7M, 7C and 7K (primary transfer) so that a superimposed color image is formed. Paper P accommodated in the sheet feed cassette 20 of the sheet feed/conveyance section is fed by a sheet feed means 21, and is conveyed to the transfer means 7A through the sheet feed rollers 22A, 22B, 22C and resist roller 23. Then a color image is transferred onto the paper P (secondary transfer). The paper P with a color image transferred thereon is fixed in position by a fixing means 24. Being sandwiched by ejection rollers 25, paper P is placed on the ejection tray 26.

In the meantime, a cleaning means 8A provided with a cleaning blade is used clean the intermediate transfer member 6 separated from paper P after a color image is transferred by the transfer means 7A.

An automatic document conveyance apparatus JG is mounted on the top of the image forming apparatus proper GH. The automatic document conveyance apparatus JG feeds the documents d placed on the document feed platen 31 one by one, and ejects them to the document ejection platen 32 through the readout position. The automatic document conveyance apparatus JG is capable of being opened and closed. When it is opened, the document can be placed on a document accommodation section 45.

Numeral 40 denotes an image scanning section, which contains;

a scanning unit 41 composed of a light source and a mirror for lighting up the document;

a scanning unit 42 including two mirrors;

an imaging lens 43;

an image-capturing device 44 composed of a CCD; and a document accommodation section 45.

In the document scanning operation using the automatic document conveyance apparatus JG, the scanning units 41 and 42 are set at the illustrated position, and the automatic document conveyance apparatus JG are set at the illustrated position. The documents d are conveyed. Then a plurality of documents d are scanned on a continuous basis. In the document scanning operation using the document accommodation section 45, the automatic document conveyance apparatus JG is opened and document d is placed on the document accommodation section 45. The scanning units 41 and 42 are moved so that the document d is scanned, whereby the document is scanned. The automatic document conveyance apparatus JG comprises an automatic duplex document conveyance means.

Figure 2:
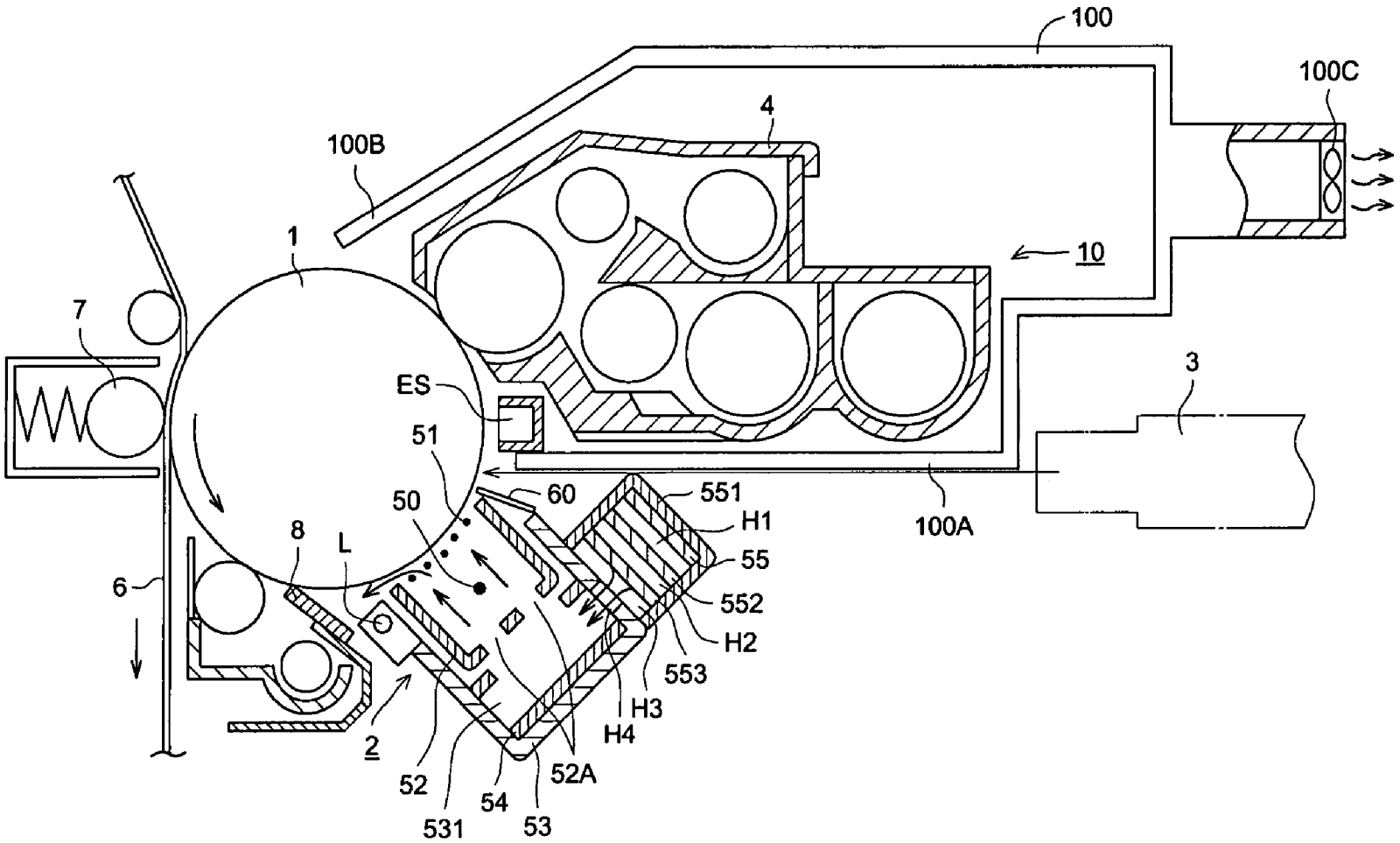
FIG. 2 is a cross sectional view partly showing the image forming section of the color image forming apparatus shown in FIG. 1.
Figure 3:
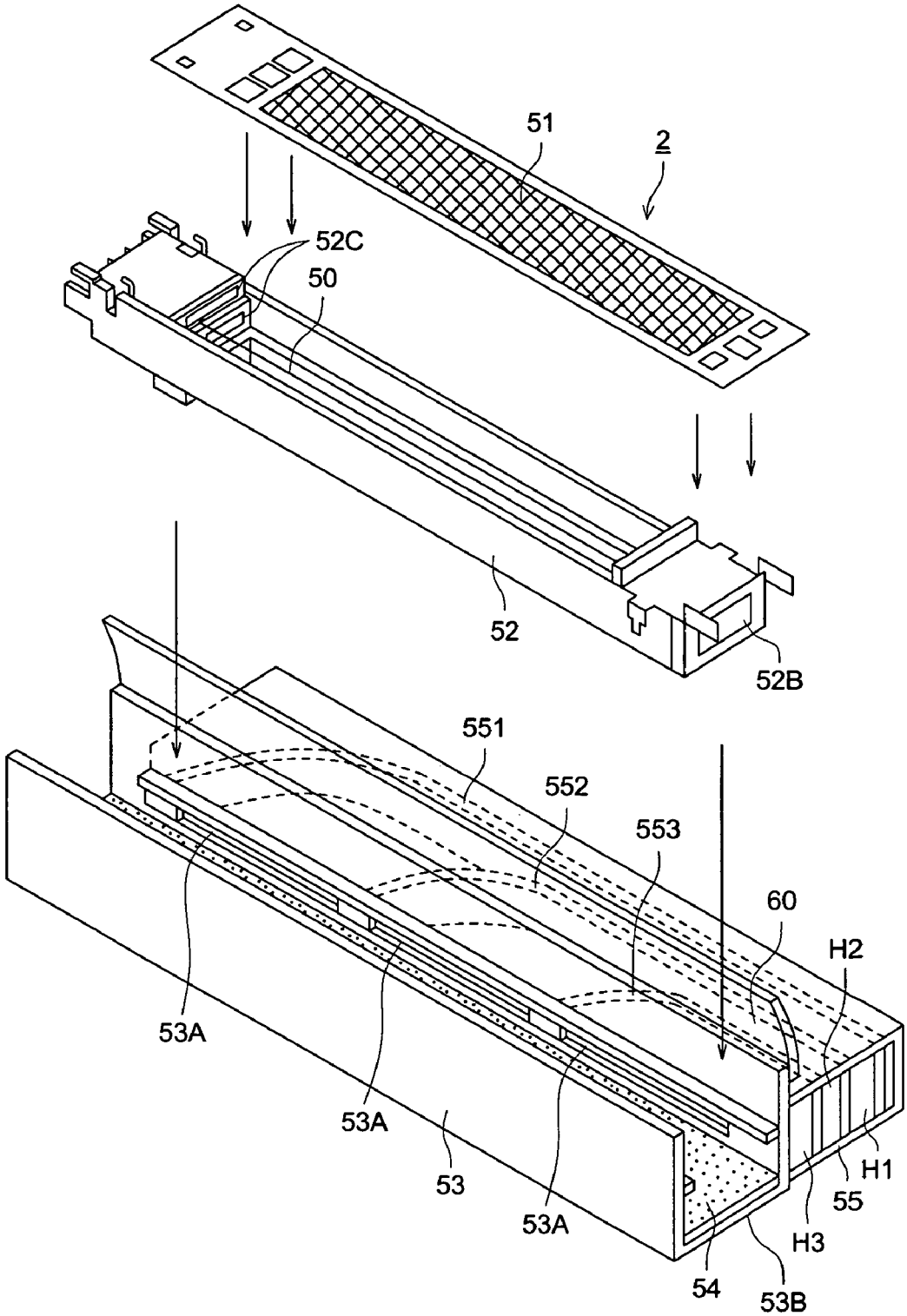
FIG. 3 is an exploded perspective view showing a charging means of the color image forming apparatus shown in FIG. 1.
Figure 4:
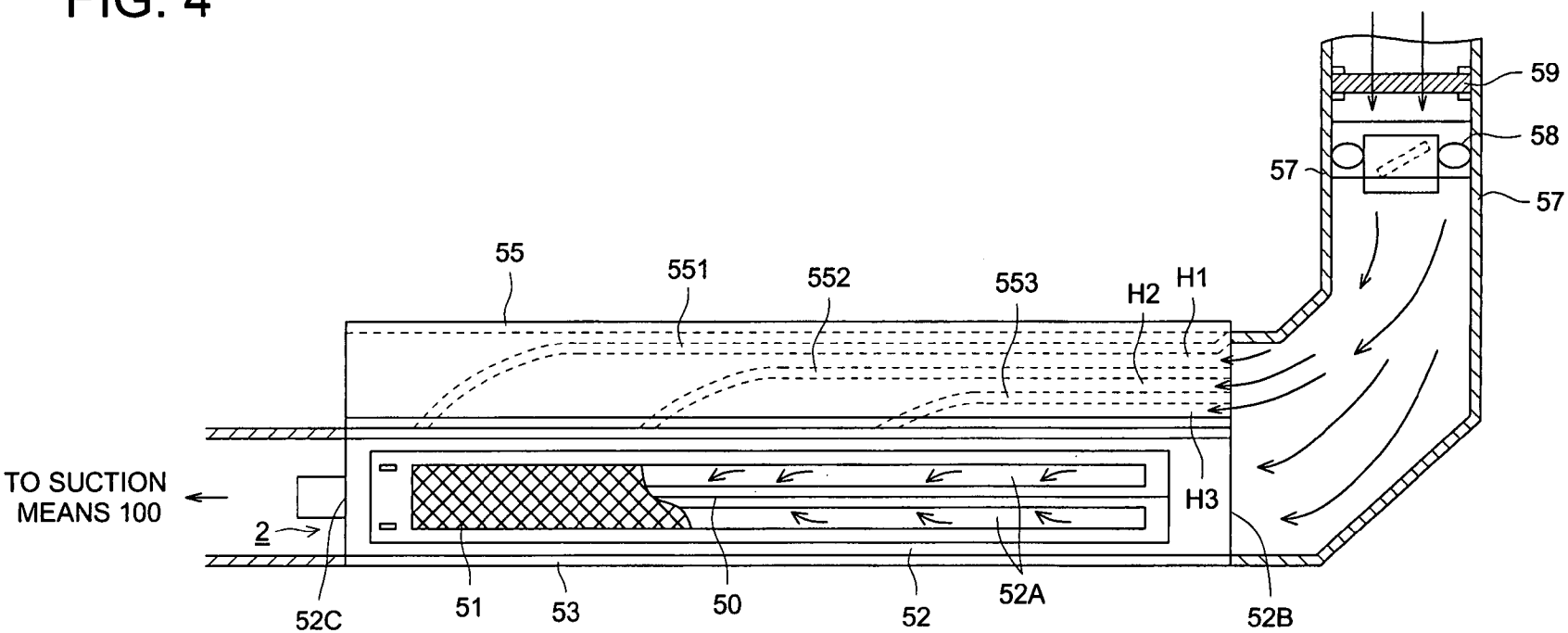
FIG. 4 is a cross sectional view showing a charging means of the color image forming apparatus shown in FIG. 1.

The following describes the structure of the image forming section, especially the charging means and suction means, with reference to:

FIG. 2 as a cross sectional view partly showing the image forming section of the color image forming apparatus shown in FIG. 1, FIG. 3 as an exploded perspective view showing a charging means of the color image forming apparatus shown in FIG. 1, and FIG. 4 as a cross sectional view showing a charging means of the color image forming apparatus shown in FIG. 1.

The structures of the image forming sections 10 in FIG. 2 are the same as those of image forming sections 10Y, 10M, 10C and 10K. The structures of the charging means 2 in FIGS. 3 and 4 are the same as those of the charging means 2Y, 2M, 2C and 2K. Symbols Y, M, C and K in the components of the image forming section 10 and charging means 2 will be omitted in the following description and FIGS. 2 through 4.

The photoconductor 1 rotates in the counterclockwise direction as shown by the arrow mark, and the charging position, exposure position and development position are set on the photoconductor 1 in the order from the bottom. To ensure such processing, the charging means 2 is arranged downward, and the development means 4 is arranged upward in such a way that the laser beam from the exposure means 3 is launched into the photoconductor 1 through the gap between the development means 4 and charging means 2.

Suction ports 100A and 100B of the duct of the suction means 100 are provided on the upstream and downstream sides respectively in the rotating direction of the photoconductor in the development means 4. The duct outlet is equipped with a suction fan 100C. The suction port 100A is a sucking means arranged on the downstream side of the charging means. The suction port 100B provides the function of a sucking means arranged on the upstream side of the charging means of the image forming section located higher by one level. The suction ports 100A and 100B extend in the vertical direction of the paper in FIG. 2, viz., in the longitudinal direction of the charging means. The length is almost the same as that of the charging means. Only the K-color image forming section located at the lowest level is provided with a suction port also on the upstream side.

The transfer means 7 transfers the toner image on the photoconductor 1 moving downward, onto the intermediate transfer member 6 also moving downward. After transfer of the image, the photoconductor 1 is cleaned by the cleaning means 8 located below the photoconductor 1. ES denotes the potential sensor for detecting the surface potential of the photoconductor 1. L indicates a pre-charging exposure means (PCL) for uniformly exposing the photoconductor 1 having been cleaned, and eliminating electric charge.

The charging means 2 comprises a discharge wire 50, a plate-formed grid 51 and a shield member 52. As shown in FIG. 2, the shield member 52 is U-shaped in the cross section, and comprises a sub-plate and a back plate located opposite to the photoconductor 1. The back plate has an opening 52A as a vent. The shape is long and narrow, as shown in FIG. 3. The charging means 2 is supported by a frame member 53 as a support means. Guided by the frame member 53, the charging means 2 can be pulled out in the direction orthogonal to the surface of paper, as shown in FIG. 2.

Both ends in the longitudinal direction of the shield member 52, viz., in the longitudinal direction of the charging means 2 are covered with a discharge wire securing member and others. One end in the longitudinal direction is equipped with the opening 52B, and the other end is provided with a suction port 52C. This suction port 52C communicates with the aforementioned suction means 100 (not illustrated). A suction force is given by the suction fan 100C.

When air is blown, flow of air indicated by the arrow mark (FIG. 2) occurs from the opening 52A to the grid 51. This flow of air, together with ozone and other discharge products, is sucked through the aforementioned suction ports 100A and 100B (strictly, suction port 100B of the image forming section arranged below). The flow of air occurring through the opening 52B in the longitudinal direction of the charging means 2, together with ozone and other discharge products, is sucked from the suction port 52C.

The frame member 53 is fitted with a duct 55 as a component of the flower means. Three air flow regulation plates 551, 552 and 553 are arranged inside the duct 55. Ventilation flues H1, H2 and H3 are formed by these air flow regulation plates, and openings 53A corresponding to these ventilation flues are arranged on the frame member 53. Air led from the openings 53A is blown uniformly to the photoconductor 1 through the opening 52A of the back plate. A duct 57 is connected to the side 53B of the frame member 53, and the air inlet of the duct 57 is equipped with a fan 58 and a filter 59. In this manner, the ducts 55 and 57, fan 58 and filter 59 constitute the blower means.

The blower means and suction means do not necessarily require a duct or filter. A fan and pump as a blower means and suction means can be installed directly as the required positions. Further, in this example, one ventilation fan and one suction fan are provided. Different fans may be used for ventilation from the opening 52A of the back plate and that from the opening 52B in the longitudinal direction. Similarly, different fans may be provided for the aforementioned suction ports 100A and 100B, and suction port 52C on the other side in the longitudinal direction of the charging means.

As shown in FIG. 2, the gap between the shield plate 52 and frame member 53 is shielded by an urethane sheet 60 on the portion below the development means 4. The bottom of the frame member 53 is bonded with a magnetic sheet 54 as a magnetic member composed of a Ferrite rubber sheet. The developer leaking from the development means 4 is prevented from entering the charging means 2, by the urethane sheet 60. At the same time, the developer is prevented from entering the frame member 53.

Further, when the charging means 2 is mounted or removed, the developer falling inside the frame member 53 may splash and stick to the discharge wire 50. A magnetic sheet 54 as a magnetic member is arranged on the bottom of the frame member 53, U-shaped in the cross section. This arrangement allows the carrier to be sucked by the magnetic sheet 54, with the result that adhesion of the carrier to the discharge wire 50 is completely prevented.

In the present invention, the surface of the grid of the charging means is made of gold. The material itself can be made of gold, or such a substrate as stainless steel and tungsten can be covered with gold. The average thickness of the gold film is preferred to be 1 through 5 μm in order to ensure effective removal of ozone and other discharge products or reduced manufacturing costs.

A film can be formed by plating, vapor deposition, sputtering and coating. Plating method is preferred in particular. Plating provides uniform formation of gold on the surface as compared to other methods, and hence ensures more effective elimination of ozone and other discharge products. As compared to the method of electrolytic plating by the prior art dc current, the method of forming a gold-plated layer by electrolytic plating method based on pulse current provides a gold-plated layer characterized by a more compact and harder texture, a smaller number of pinholes, a thinner and more uniform layer and more effective elimination of ozone and other discharge products.

The electrolytic plating method based on pulse current for forming a gold-plated layer is not particularly restricted in the process or conditions. It can be utilized in the same manner as the prior art method. There is no restriction imposed on the current used in electrolytic plating method, only if it is a pulse current. To put it more specifically, for example, it is possible to use various types of pulse current obtained by rectification of the alternating current of the commercial power supply. Use of the pulse current having a rectangular wave is preferred. The pulse width (on-time) of this pulse current can be set to a value, for example, in the range from several microseconds through a few hundred microseconds. This on-time period is preferably longer than the off-time period or changing time period. This arrangement ensures the gold-plated layer to be formed more compact in texture. The pulse current used generally has a current density of 0.5 through 1.6 A/dm$^2$, for example, and a voltage of 2 through 6 volts. In the actual gold-plating process, the grid substrate as an object to be plated is subjected to various types of pre- and post-treatment processes. By way of an example, these processes include chemical grinding, water washing, acid dipping, water washing, pure water dipping, gold plating, water washing and drying.

As compared with the dc current plating method, the electrolytic plating method by pulse current provides electrolysis of high current density in the cathode boundary. Accordingly, small-sized crystals are generated, and hence a gold plated layer of compact texture, high density and great hardness is formed. Further, this gold plated layer is a thin and uniform gold plated layer containing a smaller number of pinholes. The surface of the grid substrate forming the cathode and the gold to be deposited are obtained in such a way as to permit easier alloying. This arrangement ensures very close adhesion of the gold plated layer.

A tungsten, stainless steel or gold wire having a diameter of 20 through 150 μm is used as the discharge wire. The surface in particular is preferably made of gold. Either the wire itself can be made of gold or the surface of the stainless steel or tungsten substrate can be coated with gold. The average thickness of the gold film is preferred to be 1 through 5 μm in order to ensure effective removal of ozone and other discharge products, reduced manufacturing costs and improved discharge efficiency.

A film can be formed by plating, vapor deposition, sputtering and coating. Plating method is preferred in particular. Plating provides uniform formation of gold on the surface as compared to other methods, and hence ensures more effective elimination of ozone and other discharge products.

Figure 5:
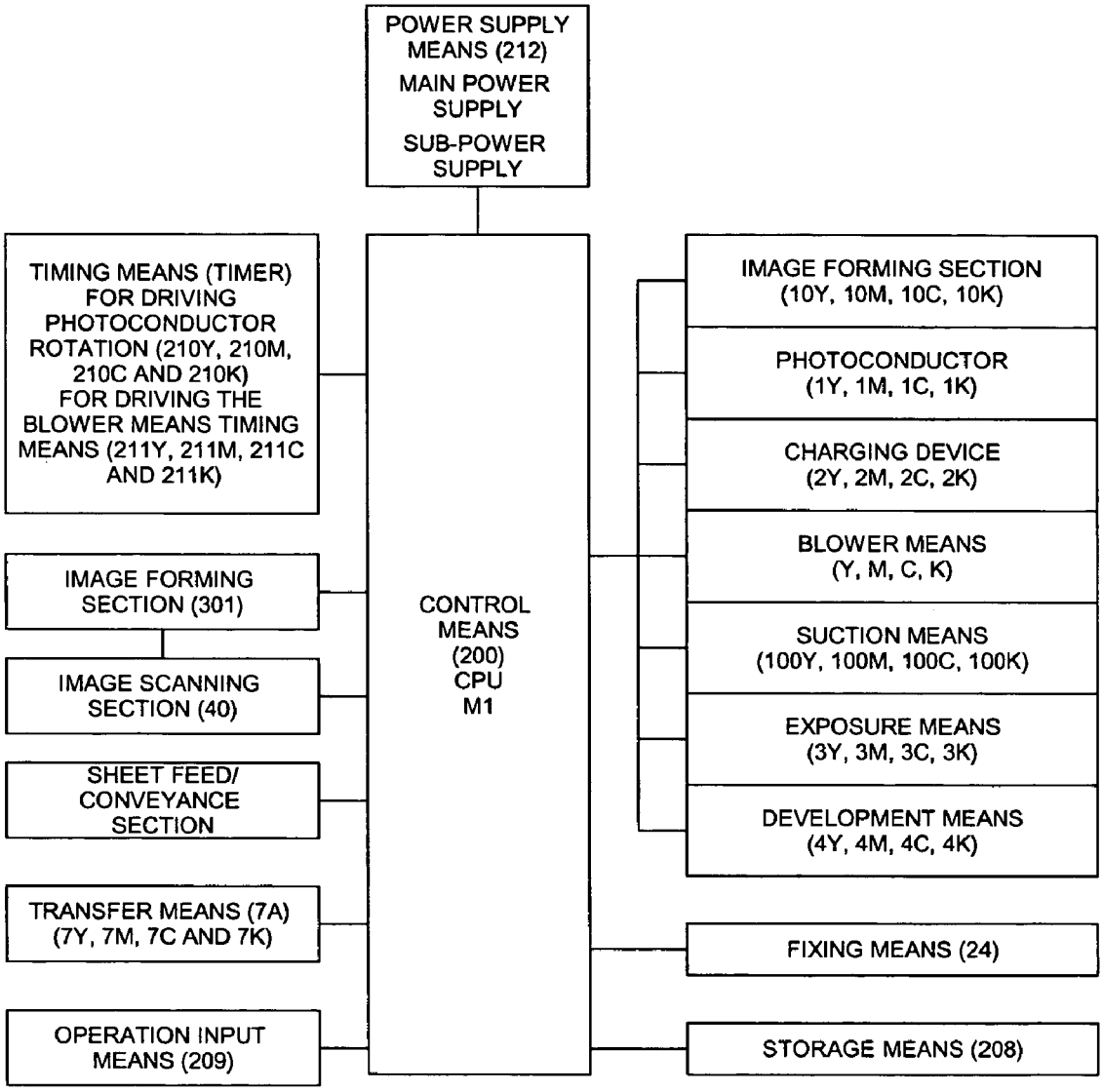
FIG. 5 is a functional block diagram of the color image forming apparatus shown in FIG. 1.

FIG. 5 is a block diagram of the image forming apparatus according to the present invention. The following describes the functional structure of the image forming apparatus according to the present invention, with reference to FIG. 5. The symbols for the same structures as those described with reference to FIG. 1 will not be described to avoid duplication.

The image forming apparatus of the present invention comprises:

a control means 200 for overall control of the operations of the image forming apparatus;

an image scanning section 40 for scanning a document image and capturing the corresponding image data;

an image processing section 301 for inputting the image data from the image scanning section and applying the image processing of filtering, gradation adjustment, scaling;

image forming sections 10Y, 10M, 10C and 10K for forming a toner image on the photoconductor based on the image data processed in the image processing section 301;

transfer means 7Y, 7M, 7C and 7K for transforming the toner image formed on the photoconductor, onto the intermediate transfer member;

a transfer means 7A for transferring the toner image on the intermediate transfer member onto a recording paper;

a sheet feed/conveyance section for supplying the transfer means 7A with recording paper;

a fixing means 24 for fixing the paper with the toner image transferred thereon;

a storage means 208 for storing rotary operation conditions such as time intervals 202Y, 202M, 202C and 202K for rotating the photoconductor, rotary distances 203Y, 203M, 203C and 203K, and linear speeds of rotation 204Y, 204M, 204C and 204K; and parameters such as times 205Y, 205M, 205C and 205K up to the termination of blower means operation after completion of image forming operations, air velocities 206Y, 206M, 206C and 206K, and air volumes 207Y, 207M, 207C and 207K;

an operation input means 209, having both the display and input functions, for inputting into the aforementioned control means 200 various settings including the setting of the number of sheets to be printed, and instructions and operations including the image formation command;

timing means 210Y, 210M, 210C and 210K (timers) for rotating the photoconductor at a predetermined time interval;

timing means 211Y, 211M, 211C and 211K (timers) for driving the blower means for a predetermined period of time; and a power supply means 213 further comprising the main power supply and sub-power supply.

The aforementioned image forming sections comprises:

a photoconductors 1Y, 1M, 1C and 1K;

sucking means 100Y, 100M, 100C and 100K, charging means 2Y, 2M, 2C and 2K having blower means for each color;

exposure means 3Y, 3M, 3C and 3K; and development means 4Y, 4M, 4C and 4K.

Figure 6:
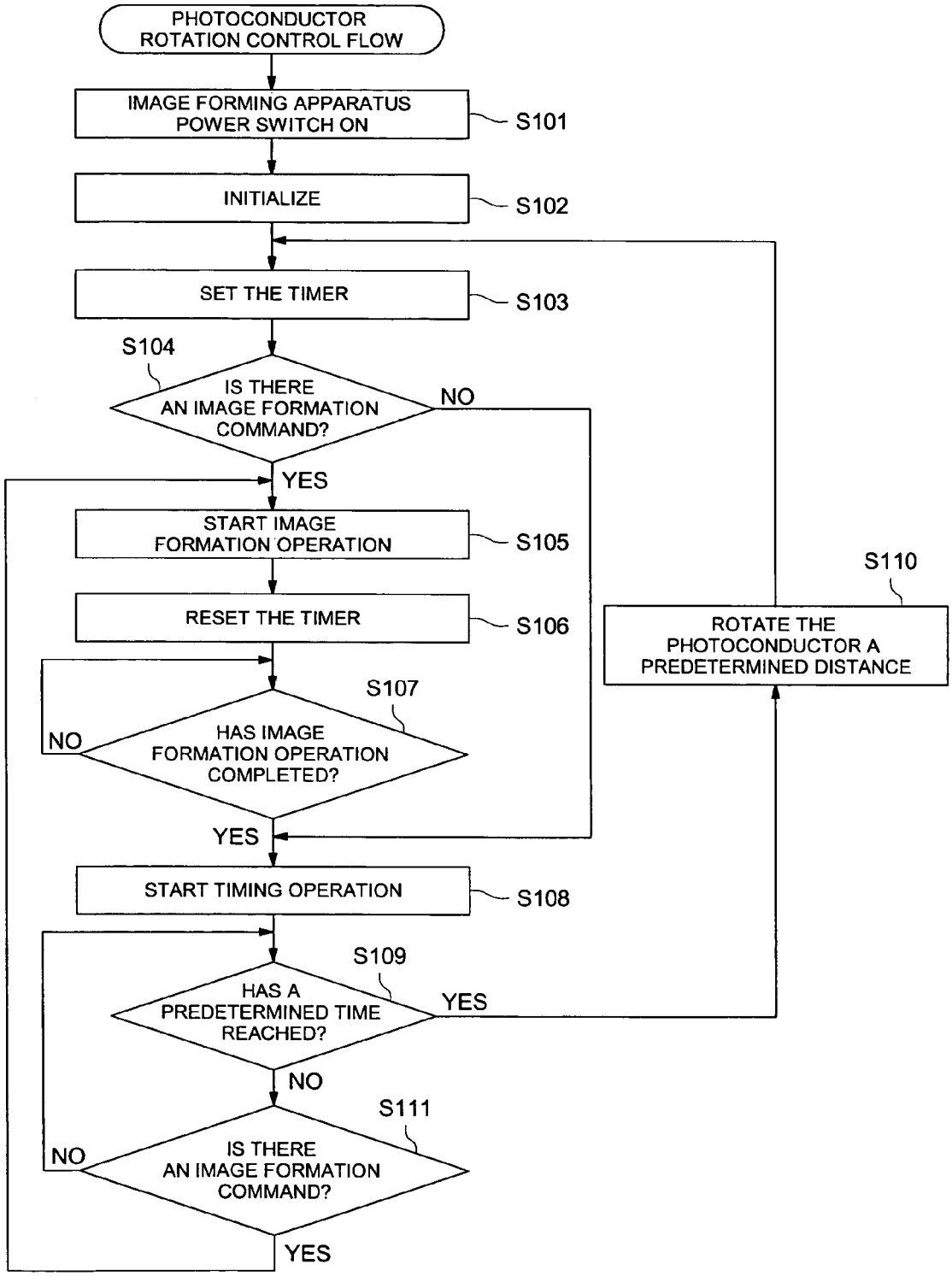
FIG. 6 is a flowchart representing the flow of the photoconductor rotation control in the color image forming apparatus shown in FIG. 1.

Each of the aforementioned means is provided with a drive means such as a motor. The control means 200 is a computer system comprising a CPU (Central Processor Unit), a memory M1, an arithmetic unit (not illustrated) and an input/output interface. Control of the aforementioned configuration is provided by executing a program stored into the memory M1 in advance. The operation of the image forming apparatus of the present invention will be described with reference to FIG. 6: Operations are the same among Y, M, C and K colors. Accordingly, symbols Y, M, C and K will be omitted in the following description.

Rotation of the photoconductor at a predetermined time interval is carried out constantly when the power switch as a main power supply is turned on and the image forming operation is disabled.

In Step S101, the main switch as the main power supply of the power supply means 212 is turned on.

In Step S102, the apparatus is initialized.

In Step S103, the timers 210 as timing means are reset.

In Step S104, the apparatus checks if there is any image formation command from the operation input means 209. If there is any (YES in Step S104), processing in Step S105 is applied. If there is no command (NO in Step S104), processing in Step S108 is applied.

In Step S105, an image is scanned from the image scanning section 40 and the image forming section 10 starts image formation operation.

In Step S106, the timers 210 are set.

In Step S107, the control means 200 checks if image formation has completed or not. If the operation has been completed (YES in Step S107), processing in Step S108 is applied. If the operation has not completed (NO in Step S107), the processing in Step S107 continues. Then the control means 200 checks if the image formation has completed or not.

In Step S108, timer 210 starts counting the time through the control means 200.

In Step S109, the control means 200 reads the time interval 202 for rotating the photoconductors 1Y, 1M, 1C and 1K, from the storage means 208, and checks the time counted by the timer 210. When the counted time has reached the time interval 202 (YES in Step S109), the control means 200 performs the processing in Step S110. If it is not reached (NO in Step S109), the control means 200 performs the processing in Step S111.

In Step S110, the control means 200 reads the rotation operation conditions including the linear speed of rotation 204 and rotary distance 203 from the storage means 208. Then it issues a command to the drive means of the photoconductor 1 so that the photoconductor 1 rotates under the specified conditions. After that, the processing in the Step S103 is executed. The rotary distance 203 is greater than the length of the charging means in the rotary direction of the photoconductor so that the positions of the photoconductor opposed to the charging means will be different before and after rotation. This arrangement ensures that the photoconductor located at the position opposed to the charging means moves to the position not opposed to the charging means. This minimizes local deterioration of the photoconductor. Further, a fin is provided at the position that is not the image forming section of the photoconductor. This arrangement improves the effect of removing ozone and other discharge products from the surface of the grid resulting from the flow of air caused by rotation of the photoconductor.

In Step S111, the control means 200 checks if there is any image formation command from the operation input means 209 or not. If there is any (YES in Step S111), processing in Step S105 is applied. If there is no command (NO in Step S111), processing in Step S109 is applied.

The above-mentioned operations are applied to each of the Y, M, C and K-color image forming sections.

Figure 7:
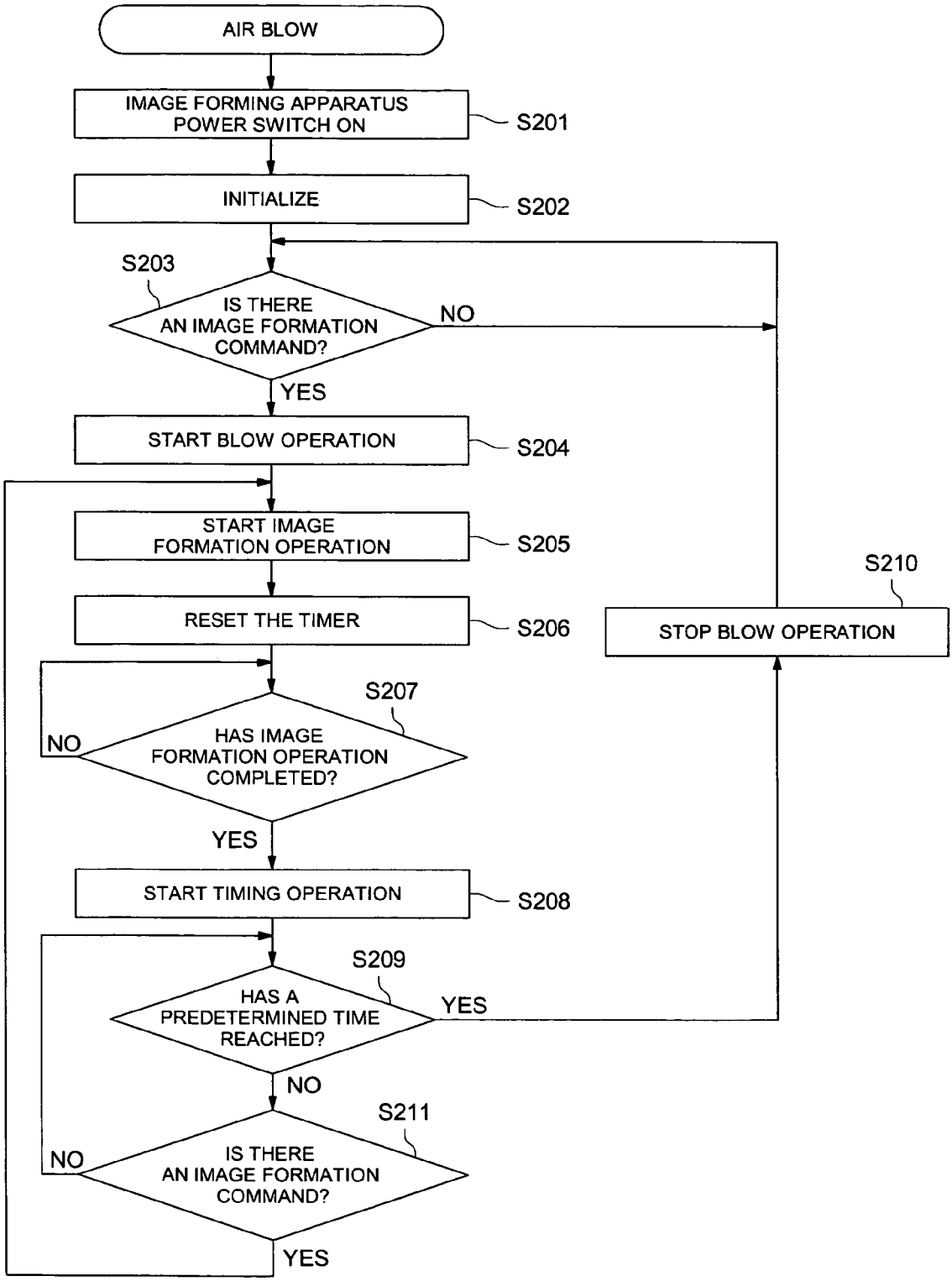
FIG. 7 is a flowchart representing the gas/air blow control flow in the color image forming apparatus shown in FIG. 1.

Referring to FIG. 7, the following describes the other embodiments of the image forming apparatus according to the present invention: Operations are the same among Y, M, C and K colors. Accordingly, symbols Y, M, C and K will be omitted in the following description.

The blower operation starts at almost the same time as the image formation operation, and completes a predetermined period of time after completion of image formation. the present image forming apparatus is provided with a battery as a power supply in addition to the main power supply. Thus, blowing operation is carried out for a predetermined period of time by the sub-power supply, even if the main power supply has been turned off during blowing operation.

In Step S201, the power switching as the main power supply of the power supply means 212 is turned on.

In Step S202, the apparatus is initialized.

In Step S203, the apparatus checks if there is any image formation command from the operation input means 209. If there is any (YES in Step S203), processing in Step S204 is applied. If there is no command (NO in Step S203), processing in Step S203 is applied.

In Step S204, the control means 200 reads the blowing conditions such as air velocity 206 and air volume 207 from the storage means 208. Then it issues a command to the drive means of the blower means, so that the operation of the blower means starts under the specified conditions.

In Step S205, the control means 200 reads an image from the image scanning section 40 and allows the image forming section 10 to start the image formation operation.

In Step S206, the timer 211 is reset.

In Step S207, the control means 200 checks if image formation operation has completed or not. If the operation has been completed (YES in Step S207), processing in Step S208 is applied. If the operation has not completed (NO in Step S207), the processing in Step S207 continues. Then the control means 200 checks if the image formation has completed or not.

In Step S208, timer 211 starts counting the time through the control means 200.

In Step S209, the control means 200 reads the time 205 required for the blower means to terminate, from the storage means 208. Then the control means 200 checks the time counted by the timer 211. When the counted time has reached the time 205 required for the blower means to stop (YES in Step S209), the control means 200 performs the processing in Step S210. If it is not reached (NO in Step S209), the control means 200 performs the processing in Step S211.

In Step S210, the control means 200 issues a command to the drive means of the blower means to stop the blower operation. Then the processing in Step S203 is executed.

In Step S211, the control means 200 checks if there is any image formation command from the operation input means 209 or not. If there is any (YES in Step S211), processing in Step S205 is applied. If there is no command (NO in Step S211), processing in Step S209 is applied.

The above-mentioned operations are applied to each of the Y, M, C and K-color image forming sections.

When the operation of the suction means 100 is to be performed at the same time, the operation of the suction means 100 preferably starts at almost the same time as the image formation operation, similarly to the blower means timing operation, and completes a predetermined time period after completion of image formation operation.

The above-mentioned control means—only one control means—performs image formation operation control, blower control and photoconductor rotation control. A plurality of control means may be used separately to take care of these forms of control.

If the blower operation and photoconductor rotation with image formation operation disabled are performed at the same time, the deterioration of the photoconductor is more effectively minimized. This arrangement is therefore preferred. Further, if the blower conditions and rotation conditions of at least two of Y, M, C and K-color image forming sections are different, the deterioration of the photoconductor is still more effectively minimized. This arrangement is therefore preferred.

The following provides a detailed description of the present invention with reference to embodiments, without the present invention being restricted thereto.

(Embodiment 1)

In the tandem full-colored copying machine shown in FIG. 1, a negatively charged OPC photoconductor was used, and the linear speed of the photoconductor rotation was 220 mm/sec. A two-component developer was used as a developing agent. The toner density was adjusted according to the measurement of the sensor for reading the magnetic permeability in the developing device, whereby the amount of toner charging was regulated. The charging device used was the scorotron charger shown in FIG. 2. To get a discharge wire, a tungsten wire having a diameter of 30 μm was provided with gold plating so that an average thickness of the gold film was 1.5 μm, and the wire was subjected to dies processing using 30 μm-diameter dies in order to ensure a smooth surface. To get a grid, a stainless steel plate was provided with a predetermined pattern by etching, and the surface of a plate-formed grid obtained in this manner was provided with gold-plating according to the electrolytic plating method based on pulse current, so that the gold had an average film thickness of 1.5 μm. The development bias of the developing device was set in such a way that the sold image density would be optimized. The intensity of laser beam for exposure was set so that the half-tone potential of the photoconductor would be kept within the desired range.

For the photoconductor, when the photoconductor was kept idle after completion of image formation operation, a test was conducted to count the time elapsed when the photoconductor was kept idle upon completion of image formation operation. The photoconductor was rotated 30 mm at the above-mentioned linear speed after the lapse of every three seconds. This distance for rotation is slightly greater than the length of the charging device in the direction of photoconductor rotation. In this case, no air was blown to the charging device.

Under the following conditions, the K-color image forming section was subjected to durability test for 200,000 prints.

At the time of startup, a halftone image was outputted at a temperature of 20° C. with a relative humidity of 50 percent, thereby checking the occurrence of white streak. After that, continuous 50,000 prints were outputted and were kept idle for 10 minutes at a temperature of 10° C. with a relative humidity of 20 percent. Then a halftone image was outputted and occurrence of white streak was checked. Continuous 100,000 prints were outputted in terms of cumulative values subsequent to startup, and were kept idle for 10 minutes at a temperature of 20° C. with a relative humidity of 50 percent. Then a halftone image was outputted and occurrence of white streak was checked. Continuous 200,000 prints were outputted in terms of cumulative values subsequent to startup, and were kept idle for 10 minutes at a temperature of 30° C. with a relative humidity of 80 percent. Then a halftone image was outputted and occurrence of white streak was checked.

COMPARATIVE EXAMPLE 1

This is the same as the first embodiment except that the discharge wire and grid are not provided with gold plating, and rotation of the photoconductor is not conducted when the photoconductor was kept idle after completion of image formation operation.

COMPARATIVE EXAMPLE 2

This is the same as the first embodiment except that rotation of the photoconductor is not conducted when the photoconductor was kept idle after completion of image formation operation.

COMPARATIVE EXAMPLE 3

This is the same as the first embodiment except that the grid is not provided with gold plating.

Table 1 shows the result of evaluation.

TABLE 1

| Number of prints | Start | 50,000 sheets | 100,000 sheets | 200,000 sheets |
|---|---|---|---|---|
| Environmental conditions | 20° C. 50% | 10° C. 20% | 20° C. 50% | 30° C. 80% |
| Embodiment 1 | B | B | B | B |
| Comparative example 1 | B | DD | C | D |
| Comparative example 2 | B | D | B | B |
| Comparative example 3 | B | D | B | B |

B: Without white streak at all. No problem at all with the image
BC: Almost without white streak at all. No problem with the image
C: With white streaks. No problem in practice
D: With white streaks and problem in practice
DD: Many white streaks. Serious problems in practice Table 1 shows that, when compared with comparative examples, the first embodiment produces excellent results without white streak. In the first embodiment, the grid was provided with gold-plating and the rotation of the photoconductor was controlled when the photoconductor was kept idle after completion of image formation operation.

(Embodiment 2)

The conditions of the image forming apparatus, development section and photoconductor are the same as those in the first embodiment except that the undermentioned blower control for the charging device, instead of the photoconductor rotation control, was conducted.

Air is blown through the opening on the back plate of the shield member of the scorotron charger shown in FIG. 2 and the vent on one side of the charging device in the longitudinal direction, and was sucked through the suction ports on the upstream and downstream sides of the charging device and on the other side of the charging device in the longitudinal direction. Air blowing and suction operations were conducted when the image formation operation is not performed and for five minutes upon completion of image formation operation. Air was blown at an air velocity of 0.3 m/sec. The air velocity was measured at the central position in the longitudinal direction on the opening of the back plate of the charging device.

Under the following conditions, the image was evaluated on the K-color image forming section:

At the time of startup, after three-minute idling, and after ten-minute idling subsequent to startup in terms of cumulative values, halftone images were outputted to check the occurrence of white streaks. A series of these tests were conducted at a temperature of 20° C. with a relative humidity of 50 percent and at a temperature of 10° C. with a relative humidity of 20 percent.

COMPARATIVE EXAMPLE 4

This is the same as the second embodiment except that the discharge wire and grid are not provided with gold plating, and air blow to the charging device or air suction is not performed.

COMPARATIVE EXAMPLE 5

This is the same as the second embodiment except that air blow to the charging device or air suction is not performed.

COMPARATIVE EXAMPLE 6

This is the same as the second embodiment except that the grid is not provided with gold plating.

Table 2 shows the result of evaluation.

TABLE 2

| Environmental conditions | 20° C. 50% | | | 10° C. 20% | | |
|---|---|---|---|---|---|---|
| Idling time | Start | 3 min. | 10 min. | Start | 3 min. | 10 min. |
| Embodiment 2 | B | B | B | B | B | B |
| Comparative example 4 | B | B | D | B | D | DD |
| Comparative example 5 | B | B | C | B | C | D |
| Comparative example 6 | B | B | C | B | BC | D |

Table 2 shows that, when compared with comparative examples, the second embodiment produces excellent results without white streak. In the second embodiment, the grid was provided with gold-plating and air blow to the charging device was carried out.

(Embodiment 3)

The conditions of the image forming apparatus, development section and others are the same as those in the second embodiment except that printing and air blow to the charging device are performed for image forming sections for four Y, M, C and K-colors.

The following test was conducted to check the optimum values for the air velocity and air volume for each color:

Continuous 1,000 prints were outputted and were kept idle for 10 minutes immediately thereafter. After these prints were kept idle for ten minutes after startup in terms of cumulative values subsequent to startup, halftone images were outputted at a temperature of 10° C. with a relative humidity of 20 percent to check occurrence of white streaks. Similarly to the case of the second embodiment, air blowing operation was conducted when the image formation operation was performed and for five minutes upon completion of image formation operation. Evaluation was made for each of Y, M, C and K colors at six air velocities shown in Table 3. Table 3 shows the results.

TABLE 3

| Air velocity | 0.1 | | | 0.3 | | | 0.5 | | |
|---|---|---|---|---|---|---|---|---|---|
| (m/sec) Idling time | Immediately after | 3 min. | 10 min. | Immediately after | 3 min. | 10 min. | Immediately after | 3 min. | 10 min. |
| Y | B | C | C | B | C | B | B | B | B |
| M | B | C | C | B | C | C | B | C | C |
| C | C | C | C | B | C | C | B | C | C |
| K | C | C | C | C | C | C | C | C | C |
| **Air velocity** | **0.7** | | | **1.0** | | | **1.2** | | |
| (m/sec) Idling time | Immediately after | 3 min. | 10 min. | Immediately after | 3 min. | 10 min. | Immediately after | 3 min. | 10 min. |
| Y | B | B | B | B | B | B | B | B | B |
| M | B | B | B | B | B | B | B | B | B |
| C | B | C | B | B | B | B | B | B | B |
| K | C | C | C | B | C | C | B | C | B |

According to Table 3, the optimum air velocity was 0.3 m/sec. for Y color, 0.5 m/sec. for M color, 0.7 m/sec. for C color and 1.0 m/sec. for K color.

In this case, white streaks can be avoided if air is blown at a velocity of 1.0 m/sec. for all Y, M, C and K colors. However, if air was blown at a velocity of 1.0 m/sec. for all four colors, electric power consumption will exceeds the upper limit of 3 kW. Accordingly, air cannot be blow at that velocity.

In the third embodiment, air was blown at a velocity of 0.3 m/sec. for Y color, 0.5 m/sec. for M color, 0.7 m/sec. for C color and 1.0 m/sec. for K color. Under the same conditions as those in the first embodiment, 200,000 prints were outputted to conduct a durability test.

(Embodiment 4)

Under the same conditions as those in the third embodiment, except that air was blown at a velocity of 0.3 m/sec. for all colors, 200,000 prints were outputted to conduct a durability test.

Table 4 shows the result of evaluation for K color.

TABLE 4

| Number of prints | Start | 50,000 sheets | 100,000 sheets | 200,000 sheets |
|---|---|---|---|---|
| Environmental conditions | 20° C. 50% | 10° C. 20% | 20° C. 50% | 30° C. 80% |
| Embodiment 3 | B | B | B | B |
| Embodiment 4 | B | C | C | C |

Table 4 shows that, the third embodiment wherein air was blown at different optimum velocities for Y, M, C and K colors produces better results in terms of occurrence of white streak than the fourth embodiment wherein the velocity was 0.3 m/sec. for all colors. Further, the third embodiment ensures effective reduction in the occurrence of white streaks, without undue increase in power consumption during the use of the apparatus as described above. To be more specific, it can be seen that, when a plurality of image forming sections are arranged in the vertical direction, an increase in the velocity is more preferable for an image forming section located at a lower position.

As mentioned hereinbefore, these embodiments bring the following effects.

The use of a grid wherein at least the surface is made of gold reduces the force of adhesion between the grid surface and the aforementioned ozone and other discharge products. Under this condition, the ozone and other discharge products can be removed from the surface of the grid by flow of air by rotation, whereby the deterioration of the photoconductor can be minimized. Furthermore if the remaining ozone and other discharge products have reached the photoconductor, deterioration can be reduced by rotation of the image carrier(at a predetermined interval of time). Thus, local deterioration of the photoconductor can be reduced, according to the findings of the present inventors.

The rotating distance of the image carrier is longer than the charging means, and the image carrier located opposite to the charging means completely moves to the position not opposed to the charging means. Therefore the sites of the image carrier opposed to the charging means are different before and after rotation, and the local deterioration of the photoconductor can be reduced.

The operation conditions for rotation are different between the first and second image carriers. This arrangement ensures efficient and reliable reduction of the deterioration of the image carrier, even if the degree of deterioration of the image carrier due to the ozone and other discharge products is different between the first image carrier and the second one arranged below the first image carrier for some reason.

The operation conditions can be easily modified by changing the time interval for rotation. This arrangement ensures efficient reduction of the deterioration of the image carrier.

The ozone and other discharge products are generally heavier than air, and tend to move downward. The temperature in an upper portion of the apparatus is higher since hot gas/air tends to flow upward. This causes easier decomposition of ozone and other discharge products. Accordingly, the second image carrier arranged downward tends to deteriorate more easily than the first one located upward. In such cases, the time interval of rotating the second image carrier is made shorter than the time interval of rotating the first one. This arrangement ensures efficient and reliable dispersion of deterioration, and minimizes the deterioration of the image carrier as a result of increased frequency of gas/air generation due to rotation.

A hermeticity is improved by division of the apparatus into smaller units. Since ozone and other discharge products tend to stay around the image carrier in this environment, the remarkable effect of the present invention can be fully appreciated.

The gas/air flow occurs from the back of the charging means to the image carrier. This arrangement efficiently removes ozone and other discharge products from the interior of the charging means including the grid and the area around the image carrier surface.

The suction means is provided to improve the efficiency of removing the ozone and other discharge products. Further, this arrangement effectively recovers the ozone and other discharge products without allowing them spread all over.

The blowing of gas/air in the longitudinal direction, in addition to blowing of gas/air from the back of the charging means, effectively removes ozone and other discharge products from the rear sides of the discharge member and grid, which are not exposed to gas/air if blown from the back.

The blowing conditions are different between the first and second image carriers. This arrangement ensures effective and reliable reduction of the image carrier, even if the degree of deterioration of the image carrier due to the ozone and other discharge products is different between the first image carrier and the second one arranged below the first image carrier for some reason.

The easy change of the blowing conditions is provided by changing the air velocity, with the result that deterioration of the image carrier is effectively reduced.

The ozone and other discharge products are generally heavier than air, and tend to move downward. The temperature in an upper portion of the apparatus is higher since hot gas/air tends to flow upward. This causes easier decomposition of ozone and other discharge products. Accordingly, the second image carrier arranged downward tends to deteriorate more easily than the first one located upward. In such cases, the blowing force of the second blower means for the second image carrier is set at a value higher than that of the first blower means for the first image carrier. This arrangement ensures efficient and reliable reduction of the deterioration of the image carrier.

The surface of the discharge member is made of gold. This arrangement reduces the force of adhesion between the surface of the discharge member and ozone and other discharge products. Ozone and other discharge products are removed from the surface of the discharge member by the flow of air during rotation of the image carrier and the flow of gas/air during blowing operation, with the results that deterioration of the image carrier is minimized.

The film of gold is uniformly formed on the surface by gold plating. This ensures easier elimination of ozone and other discharge products.

The comparatively large amount of ozone and other discharge products when a discharge wire is used. In such cases, the remarkable effect of the present invention can be fully appreciated.

What is claimed is:

1. An image forming apparatus, comprising:

an image carrier for carrying a toner image;

a charging device for charging the carrier, wherein the charging device includes a discharge member and a grid which is arranged between this discharge member and the image carrier and has at least a surface made of gold; and a discharge product removing device for removing discharge products generated by the charging device from a portion of the image carrier to where the charging device is located to face;

wherein the discharge product removing device is a rotation control device for rotating the image carrier at a predetermined time intervals when the image formation mode is disabled so that the image carrier located opposite to the charging means completely moves to the position not opposed to the charging means;

wherein the image carrier comprises a first image carrier and a second image carrier arranged below the first image carrier; the charging device comprises a first charging device for charging the first image carrier; and a second charging device for charging the second image carrier; and wherein the rotation control device controls in such a way that the conditions for rotation at a predetermined time interval are different between the first image carrier and second image carrier.

2. The image forming apparatus of claim 1, wherein the rotation control device is designed in such a way that the rotary distance in one rotation of the image carrier is longer than the charging device in the direction of rotation of the image carrier, and the sites of the image carrier opposed to the charging device are different before and after rotation.

3. The image forming apparatus of claim 1, wherein the operation condition refers to the time interval.

4. The image forming apparatus of claim 1, wherein the time interval for rotation of the first image carrier is shorter than the time interval for rotation of the second image carrier.

5. The image forming apparatus of claim 1, wherein the image forming apparatus is divided into two units of a first image forming unit comprising the first image carrier and first charging device; and a second image forming unit comprising the second image carrier and second charging device.

6. An image forming apparatus, comprising:

an image carrier for carrying a toner image;

a charging device for charging the carrier, wherein the charging device includes a discharge member and a grid which is arranged between this discharge member and the image carrier and has at least a surface made of gold; and a discharge product removing device for removing discharge products generated by the charging device from a portion of the image carrier to where the charging device is located to face, wherein the discharge product removing device comprises a blower for supplying gas or air flow to the charging device and a blower control device for operating the blower for a predetermined time following the termination of image formation operation;

wherein the image carrier comprises a first image carrier and a second image carrier arranged below the first image carrier; the charging device comprises a first charging device for charging the first image carrier and a second charging device for charging the second image carrier; and the blower comprises a first blower for blowing gas or air to the first charging device and a second blower for blowing gas or air to the second charging device; and wherein the blower control device controls in such a way that the blowing conditions are different between the first blower and second blower.

7. The image forming apparatus of claim 6, further comprising: a rotation control device for rotating the image carrier at a predetermined time interval when the image formation is not performed.

8. The image forming apparatus of claim 6, wherein the charging device comprises a shield member having an opening on the side opposite to the image carrier and the blower blows gas or air from the opening to the image carrier.

9. The image forming apparatus of claim 6, wherein a suction device for sucking gas or air is provided on at least one of the upstream and downstream sides of the charging device in the rotational direction of the image carrier.

10. The image forming apparatus of claim 6, wherein the blower blows gas or air from one side in the longitudinal direction of the charging device.

11. The image forming apparatus of claim 10, wherein a suction device for sucking air is arranged on one side in the longitudinal direction of the charging device.

12. The image forming apparatus of claim 6, wherein the blowing condition refers to an air velocity.

13. The image forming apparatus of claim 6, wherein the blowing condition of the first blower has a higher blowing power than the second blower.

14. The image forming apparatus of claim 6, wherein the image forming apparatus is divided into two units of a first image forming unit comprising the first image carrier, first charging device and first blower; and a second image forming unit comprising the second image carrier, second charging device and second blower.

15. The image forming apparatus of claim 6, wherein the discharge member is a discharge wire.

* * * * *